United States Patent [19]

Shelley

[11] 4,387,999

[45] Jun. 14, 1983

[54] ELECTRONIC SUNDIAL APPARATUS

[76] Inventor: Edwin F. Shelley, 339 Oxford Rd., New Rochelle, N.Y. 10804

[21] Appl. No.: 296,161

[22] Filed: Aug. 25, 1981

[51] Int. Cl.[3] ..... G04B 19/26

[52] U.S. Cl. ..... 368/15; 368/62; 33/268

[58] Field of Search ..... 33/267–271; 368/15, 62, 205

[56] References Cited

U.S. PATENT DOCUMENTS 3,440,426 4/1969 Bush ..... 33/268
4,135,357 1/1979 Ashton ..... 368/15

FOREIGN PATENT DOCUMENTS 2471627 6/1981 France ..... 33/270

*Primary Examiner*—Bernard Roskoski
*Attorney, Agent, or Firm*—Kenyon & Kenyon

[57] ABSTRACT

An electronic sundial apparatus which signals the passage of each hour by a chime, bell or other audible indication and which requires no external source of power other than the sun. Inner and outer concentric hemispheres with vertically extending apertures, specifically slits, configured so as to diverge at their uppermost ends and having a location, length and shape corresponding to the azimuths and distance between the maximum and minimum altitudes of the sun in the sky at each hour throughout the year at predetermined latitudes collimate the sunlight once each hour. The collimated sunlight is detected by a photoelectric cell coupled to a signaling circuit powered by a photovoltaic cell.

7 Claims, 4 Drawing Figures

ELECTRONIC SUNDIAL APPARATUS

BACKGROUND OF THE INVENTION

1. Field of the Invention

The present invention relates generally to sundials, and in particular to an electronic sundial apparatus which signals, on an hourly basis, the passage of time.

2. Description of the Prior Art

Sundials are, of course, known in the art. Heretofore, however, such sundials were not designed so as to audibly signal the passage of time. The present invention provides a sundial apparatus which operates solely on solar energy and indicates on an hourly basis, by an audible signal, the passage of time.

SUMMARY OF THE INVENTION

The present invention comprises an electronic sundial apparatus which is responsive to changes in the position of the sun in the sky for signaling, on an hourly basis, the passage of time. The sundial comprises a first hemisphere having an elongated vertically-disposed aperture, specifically a slit, and a plurality of elongated, generally vertically extending diverging slits disposed in the surface thereof at predetermined locations. The diverging slits are configured so as to diverge at their uppermost ends in opposite directions away from the vertically disposed slit. All the slits have a predetermined location and a predetermined length and shape on the hemisphere which correspond to the azimuths and the distance between the maximum and minimum altitudes of the sun in the sky at each hour throughout the year for a predetermined, selected latitude. The second hemisphere is disposed concentrically within the first hemisphere and also includes a plurality of similarly disposed and similarly configured elongated slits. These slits function in conjunction with those in the first hemisphere to collimate sunlight once each hour and cause the collimated sunlight to pass through the concentric radial center of the hemispheres. The slits are preferably disposed in the hemisphere so that the lower ends thereof are spaced apart by an angle of approximately 15° on the surface of the hemisphere and the uppermost ends are spaced apart by an angle ranging between approximately 15° and 60° on the surface of the hemisphere. A detector, such as a photoelectric cell, is disposed at the concentric center of the hemispheres for detecting the presence of the sunlight collimated by the hemispheres. Means, which preferably includes a photovoltaic power cell and chime synthesizing means, is coupled to the detector to signal the detection of collimated sunlight by the detector.

The foregoing apparatus may signal the passage of each hour by, for example, a chime, bell or other audible indication, and requires no external source of power other than the sun. These and other novel features and advantages of the invention will be described in greater detail in the following detailed description.

DETAILED DESCRIPTION

Figure 1:
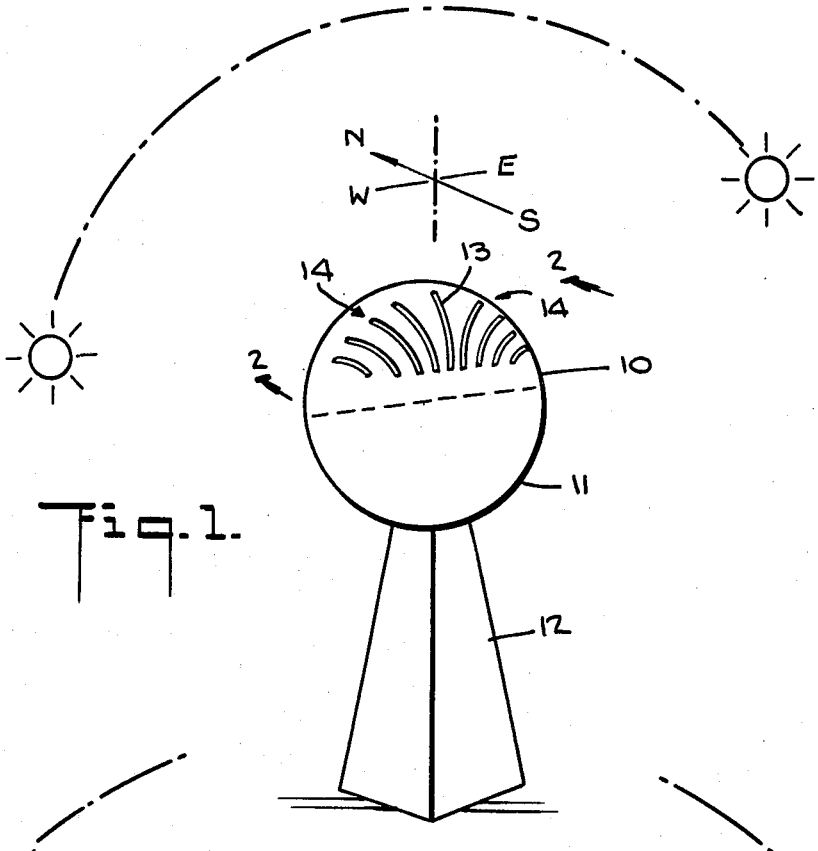
FIG. 1 is a perspective view of an electronic sundial apparatus constructed in accordance with the present invention.

Referring now to FIG. 1, there is shown an electronic sundial apparatus comprising an upper hemisphere 10 and a lower, decorative hemisphere 11 disposed on a stationary support 12. The upper hemisphere 10 includes a plurality of elongated apertures, illustrated as a plurality of slits, disposed in the surface thereof, specifically a vertically-disposed slit 13 and a plurality of generally vertically extending diverging slits 14 which diverge at their uppermost ends away from vertical slit 13. The slits are disposed in predetermined locations on hemisphere 10 and have a predetermined length and shape corresponding to the azimuths and the distance between the maximum and minimum altitudes of the sun in the sky at each hour throughout the year for a predetermined, selected latitude. The upper hemisphere 10 is oriented so that vertical slit 13 faces due south and the diverging slits 14 are disposed in the hemisphere so that the lower ends thereof are spaced apart by an angle of approximately 15° on the surface of the hemisphere. The uppermost ends of the slits are spaced apart by an angle which ranges between about 15° and 60° on the surface of the hemisphere. In, for example, a 60-inch diameter hemisphere, 1° would be equal to approximately $\frac{1}{2}$ inch on the circumference of the hemisphere, and $\frac{1}{4}$° would be equal to approximately $\frac{1}{8}$ of an inch (which is equal to approximately one minute of time at noon on December 21st). In a 12-inch diameter hemisphere, 1° would be equal to 1/10 of an inch on the circumference of the hemisphere, and in a 6-inch diameter hemisphere, 1° would be equal to 1/20 of an inch. In both, 1° is approximately equal to 4 minutes of time at noon on December 21st.

Figure 2:
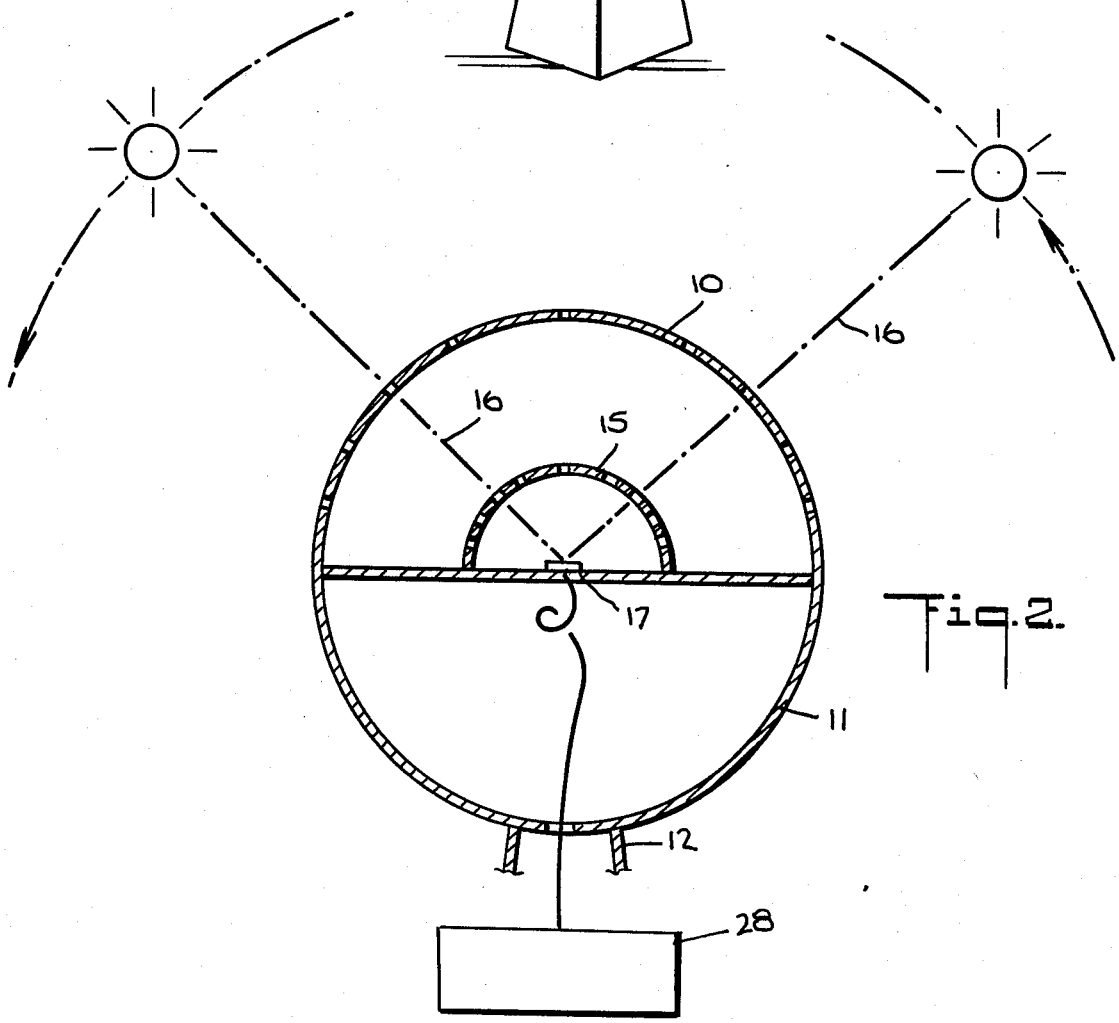
FIG. 2 is a cross-sectional view of the sundial apparatus taken along Section 2—2 of FIG. 1.

As illustrated in FIG. 2, a second, upper hemisphere 15 is disposed concentrically within the first hemisphere 10 and is fixed with respect thereto. The second hemisphere preferably has a diameter which is approximately one-half or less than that of upper hemisphere 10 and also includes a vertically-extending slit and generally vertically extending diverging slits which are proportional in length and identical in configuration to slits 13 and 14 of upper hemisphere 10. The slits of upper hemisphere 15 function in conjunction with the slits of the first upper hemisphere 10 to collimate sunlight once each hour and cause the collimated sunlight to pass through the concentric radial center of the hemispheres. (The path of the sunlight collimated by the hemispheres 10 and 15 is illustrated by dashed lines 16 in FIG. 2.) Located at this concentric center is a detector 17, preferably a photoelectric cell, which detects the presence of the sunlight collimated by hemispheres 10 and 15. The detector is coupled to signaling means 28 which signals the detection of the collimated sunlight by the detector means.

Figure 3:
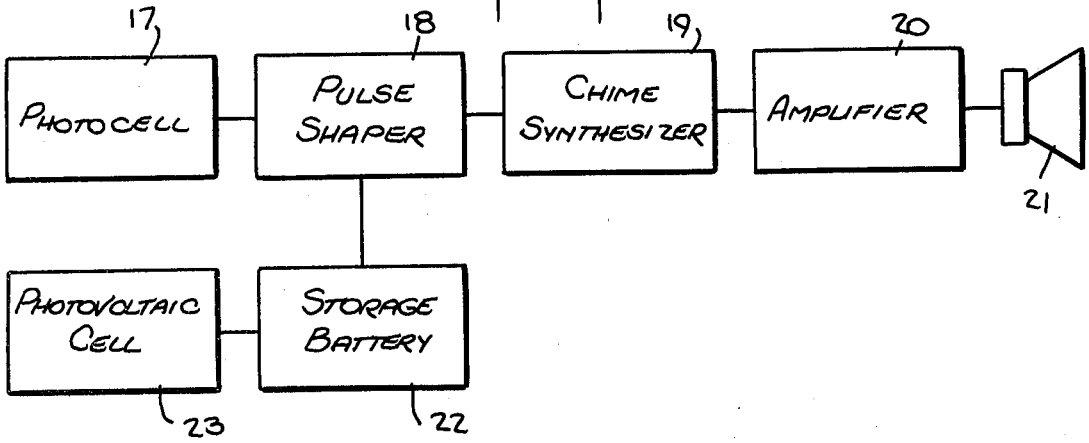
FIG. 3 is a schematic block diagram of the detector and signaling means of an electronic sundial apparatus constructed in accordance with the present invention.

FIG. 3 schematically illustrates the signaling means 28 of the apparatus of the invention. As illustrated, the photoelectric cell 17 is coupled to a pulse shaper 18 which in turn is coupled in series to a solid-state chime synthesizer 19, an amplifier 20 and a loudspeaker 21. The signaling means also includes a source of electrical power, such as a storage battery 22, and a photovoltaic cell 23 which is used to charge the battery. The embodiment of the signaling means illustrated is merely exemplary, however, and for example, the chime synthesizer may be replaced by a bell or any other suitable device for audibly signaling the detection of the collimated sunlight. The photovoltaic cell of the signaling means is disposed outside the sphere so as to be exposed to sunlight for generating electrical power to charge the storage battery 22 between the hourly collimation of sunlight. Also, a bimetallic element may be utilized to detect the collimated sunlight and strike a mechanical chime or bell once each hour.

Figure 4:
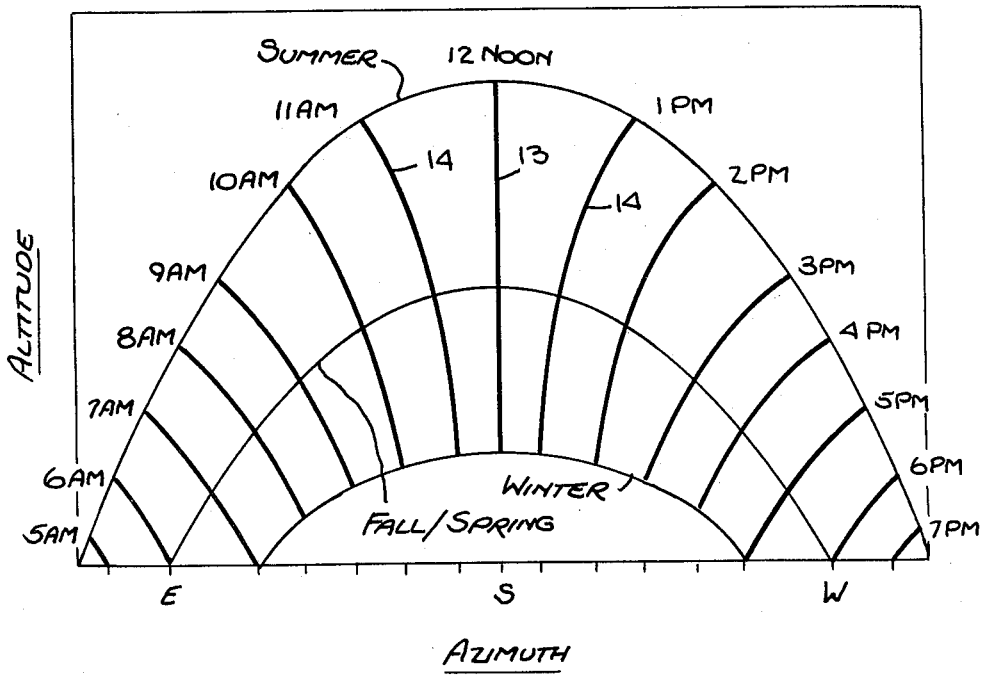
FIG. 4 is a graphical illustration of a typical slit configuration illustrating the uppermost and lowermost positions of the sun, and its path through the sky, during the various seasons of the year.

FIG. 4 graphically illustrates the general configuration of the slits in hemispheres 10 and 15. Generally speaking, the uppermost curve in the Figure represents the path of the sun in the sky during summer, the middle curve the path of the sun during spring and fall, and the lowermost curve the path of the sun during winter. The lines approximately at right angles to the sun path curves, and labeled with hours, represent the azimuth and altitude of the sun throughout the year at each hour. These lines therefore define the location, length and shape of the slits required for proper operation of the sundial at the selected latitude for which the graph has been constructed. The lower ends of the slits are spaced apart by an angle of approximately 15°. The uppermost ends of the slits diverge from the vertical slit and diverge from each other at an angle ranging between about 15° and 60°. Generally speaking, the uppermost ends of the slits diverge less from each other and the vertical slit at greater latitudes than at lower latitudes. Further information and graphs which, in effect, define appropriate slit configurations for various latitudes are shown in "The Passive Solar Energy Book" by Edward Mazzaria (Rodale Press) pp. 310 et seq., and "Principles of Solar Engineering" by Frank Kreith and J. F. Kreder (McGraw Hill) pp. 681 et seq.

In operation, concentric hemispheres 10 and 15 are positioned so that the vertical slits 13 in each face due South, as shown in FIG. 1. As the sun moves across the sky from East to West, its sunlight is collimated once each hour by the matching slits 13 and 14 in the hemispheres. This collimated beam of sunlight (illustrated by dashed lines 16) is detected by photoelectric cell 17 at the center of the hemispheres irrespective of the particular hour of the day or seasonal elevation of the sun. Once each hour (each time a collimated beam is detected) the photoelectric cell generates a pulse of electrical voltage which is shaped by the pulse shaper 18 and triggers chime synthesizer 19. The chime synthesizer produces an output signal which is amplified by amplifier 20 and transformed into an audible signal by loudspeaker 21. Electrical power to operate the chime synthesizer is obtained from the photovoltaic cell 23 and storage battery 22.

The sundial will normally chime the hour in accordance with "sun time" but the configuration of the slits may be designed to correct for "clock time" if desired. At any given longitude, the slit configuration can be designed to compensate for the difference between sun time and standard time at that location. The sundial may also be made in any size and may comprise only a hemisphere on any suitable base, or, as illustrated in the drawings, a hemisphere joined to a decorative lower hemisphere to form a complete sphere. The sundial may also be incorporated in an artistic sculpture and may be combined with an ordinary analog or digital clock if so desired. In addition, the hemispheres may be made of transparent material and off-printed with a pattern that opaques the hemispheres except for the slits (which are in this embodiment transparent areas on the surfaces of the hemispheres) so as to correspond to various latitudes, so that a series of hemispheres, off-printed to correspond to various latitudes, can be utilized with a universal base to permit the sundial to operate at any chosen latitude. It should be noted that although the apertures in the hemispheres have been illustrated as elongated slits, the apertures may also take the form of a series of discrete, unconnected apertures, for example, circular in shape.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. An electronic sundial apparatus responsive to changes in the position of the sun in the sky for signaling, on an hourly basis, the passage of time, comprising:

a first hemisphere having an elongated, vertically-disposed aperture and a plurality of elongated generally vertically extending diverging apertures disposed in the surface of said hemisphere at predetermined locations thereon, said diverging apertures being configured so as to diverge at the uppermost ends thereof in opposite directions away from said vertically-disposed aperture, said vertically-disposed and diverging apertures having a predetermined location and a predetermined length and shape corresponding to the azimuths and the distance between the maximum and minimum altitudes of the sun in the sky at each hour throughout the year for a predetermined, selected latitude;

a second hemisphere disposed concentrically within said first hemisphere, said second hemisphere also including an elongated vertically-disposed aperture and a plurality of elongated, generally vertically extending diverging apertures disposed in the surface of said hemisphere at predetermined locations thereon, said diverging apertures being configured so as to diverge at the uppermost ends thereof in opposite directions away from said vertically-disposed aperture, said vertically-disposed and diverging apertures having a predetermined location and a predetermined length and shape corresponding to the azimuths and the distance between the maximum and minimum altitudes of the sun in the sky at each hour throughout the year for a predetermined, selected latitude, said apertures functioning in conjunction with said apertures in said first hemisphere to collimate, once each hour, sunlight and cause said collimated sunlight to pass through the concentric radial center of said hemispheres;

detector means, disposed at said concentric center of said hemispheres, for detecting the presence of said sunlight collimated by said hemispheres; and means, coupled to said detector means, for signaling the detection of collimated sunlight by said detector means.

2. The apparatus recited in claim 1, wherein said vertically-disposed and diverging apertures are disposed in said hemispheres so that the lower ends thereof are spaced apart by an angle of approximately 15° on the surfaces of said hemispheres, and the uppermost ends of said apertures are spaced apart by an angle ranging between about 15° and 60° on the surfaces of said hemispheres.

3. The apparatus recited in claim 2, wherein said apertures comprise elongated vertically-disposed and diverging slits.

4. The apparatus recited in claim 1, wherein said signaling means comprises means for audibly signaling detection of collimated sunlight by said detector means, thereby audibly signaling the hourly passage of time.

5. The apparatus recited in claim 4, wherein said audible signaling means includes chime synthesizing means.

6. The apparatus recited in claim 1, wherein said detector means comprises a photoelectric cell.

7. The apparatus recited in claim 6, wherein said signaling means includes a photovoltaic power cell and storage means for storing electrical power produced by said power cell.

* * * * *